United States Patent [19]

Teeters

[11] 4,199,908

[45] Apr. 29, 1980

[54] POST BASE ELEVATOR

[76] Inventor: Darrel L. Teeters, 12146 Fourth St., Yucaipa, Calif. 92399

[21] Appl. No.: 930,043

[22] Filed: Aug. 1, 1978

[51] Int. Cl.[2] ..... E04H 12/22

[52] U.S. Cl. ..... 52/295; 52/296; 248/357

[58] Field of Search ..... 52/170, 40, 293–298, 52/239, 726; 248/156, 511, 530, 533, 536, 357; 182/87, 108; 405/250

[56] References Cited

U.S. PATENT DOCUMENTS

| | | | |
|---|---|---|---|
| 1,544,863 | 7/1925 | Ross | 52/295 |
| 1,679,297 | 7/1928 | Ehrler | 52/166 X |
| 2,859,486 | 11/1958 | Rovich | 52/293 X |

FOREIGN PATENT DOCUMENTS

| | | | |
|---|---|---|---|
| 403620 | 1/1909 | France | 52/295 |
| 495920 | 11/1938 | United Kingdom | 248/357 |

*Primary Examiner*—Ernest R. Purser

*Attorney, Agent, or Firm*—Shoemaker and Mattare, Ltd.

[57] ABSTRACT

A device for establishing and maintaining a predetermined gap spacing between a post which is supported in an upright orientation and a supporting base. The device is adjustable to permit lateral movement of the supported post while maintaining the gap spacing constant.

10 Claims, 5 Drawing Figures

POST BASE ELEVATOR

BACKGROUND OF THE INVENTION

The present invention relates in general to supports, and more particularly to post supports.

When a roof is supported by posts set in a concrete base, a usual procedure is to set a U-shaped steel supporting bracket, or post anchor, into the concrete before that concrete hardens. The bracket is of a size corresponding to the post to be supported. The post is then positioned between the bracket legs and fastened thereto. Recent changes in various building codes have required a prescribed clearance space or gap between the post lower end and the top surface of the concrete base. This gap is defined in building codes such as Uniform Building Code Chap. 2517-4 as being two or more inches.

Those presently known post supports which comply with the gap requirement of the building codes are formed by welding a cross-piece between the bracket legs at the height required by the building code. While there are several forms of known post anchors, none of these include proper gap defining elevation plus lateral adjustment capabilities.

It is quite difficult to position the supporting bracket so precisely as not to require adjustment thereof in the concrete base. It is not uncommon to require an adjustment of the bracket of ¼ to ½ inch or more. Such movement creates many problems, especially if the post is required to be spaced above the upper surface of the concrete base.

Another disadvantage of known elevated anchors is that any lateral adjustment causes the post to hang over the edge of the base. Such positioning is not only unsightly, but also vitiates some of the weight bearing capability of the post. Such a post is out of plumb position and unaligned.

Thus, there is need for a device which establishes and maintains a desired gap between a support post and a supporting base while permitting lateral adjustment of the post on the base.

SUMMARY OF THE INVENTION

The device embodying the teachings of the present invention establishes and maintains a predetermined gap between a supported upright post and a base, such as a concrete footing, or the like, while permitting lateral adjustments of the post.

The device includes an elongate channel-shaped end cap sized to accommodate standard wood post sizes and having a base portion which is attached to the lower end of the post and a pair of flanges each having defined therein, in one embodiment, an elongate slot which extends longitudinally of the end cap. A supporting bracket is embedded in a footing and, in one embodiment, has a pair of upstanding legs which each has a fastener receiving hole defined therein. The end cap does not need the slot, and is attached to the post by nails, screws or the like. Thus, the device including this end cap will be capatible with most anchoring devices without any changes being necessary to those anchors.

The post can be moved laterally to be adjusted easily. The end cap is the same size as the post and is attached to the post, so that when the post is moved laterally the post end cap moves along with the post. A major advantage is thus provided the presently disclosed device over known devices in that the full weight bearing capabilities of the post are maintained. The post remains in the aligned, plumb position.

In the other embodiment, the bracket holes and the slots are oriented so that when a fastener, such as a bolt, or the like, is inserted through the holes and the slots, the flange outer terminal edges contact the supporting base and the post lower end is thus spaced away from that supporting base. The flanges have a width as measured from the cap base portion to the terminal edge which corresponds to the desired gap spacing between the post and the supporting base. By varying the distance between the slots and the end cap base portion, the gap between the supporting base and the post can be varied.

The slots permit lateral adjustment of the post while the gap between the post and the support remains unchanged. The adjustment permitted by the slot is, of course, lateral and not vertical. The post is elongate, and therefore has a horizontal centerline which is essentially vertical, and after connection to the supporting bracket, the adjustment permitted by the device disclosed herein is transverse to the post upright longitudinal centerline, not along that centerline.

The post elevator device of the present invention provides post elevation, such as that required by the Uniform Building Code, and is in a form which makes it compatible with most commonly used U-shaped post anchors. The elevator device of the present invention can be used with both regular and heavy duty post anchors, and is not permanently attached to the anchoring device, and therefore can be changed to redefine the gap, move the post laterally, or the like.

OBJECTS OF THE INVENTION

It is therefore a main object of the present invention to establish and maintain in predetermined gap between a supported post and a supporting base while permitting lateral movement of that post.

Another object of the present invention is to provide a simple means for elevating wood structural posts and which permits lateral adjustment and can be used in conjunction with a variety of post anchors.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
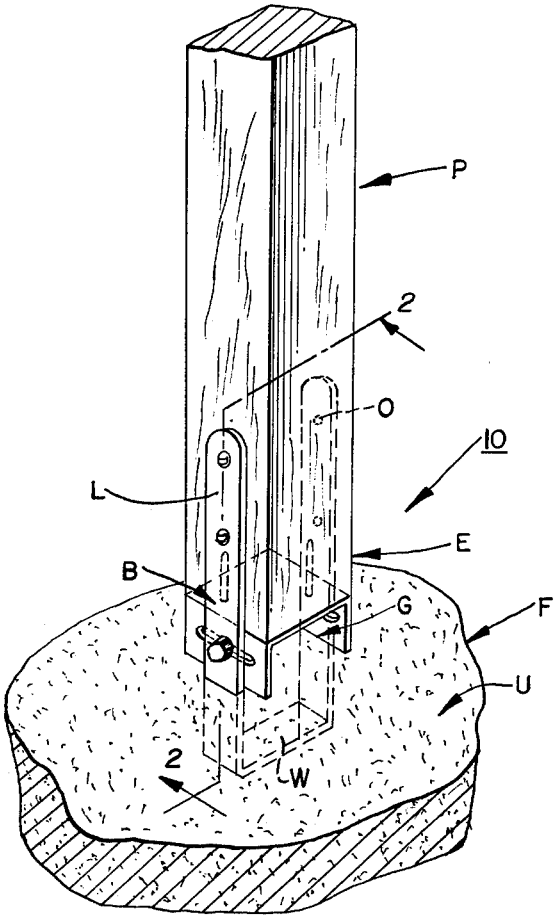
FIG. 1 is a perspective showing a post supported vertically on a supporting base by a device embodying the teachings of the present invention.

Shown in FIG. 1 is a post support device 10 embodying the teachings of the present invention. An upright post P having a lower end E and being essentially vertical in orientation is supported on and above a supporting base, such as a footing F which may be a concrete slab, or the like. The post P is supported above the footing upper surface U in accordance with the requirements of building codes, such as Uniform Building Code CHAP 2517-4 to define a gap G between the lower end of the post and the upper surface of the footing.

Figure 2:
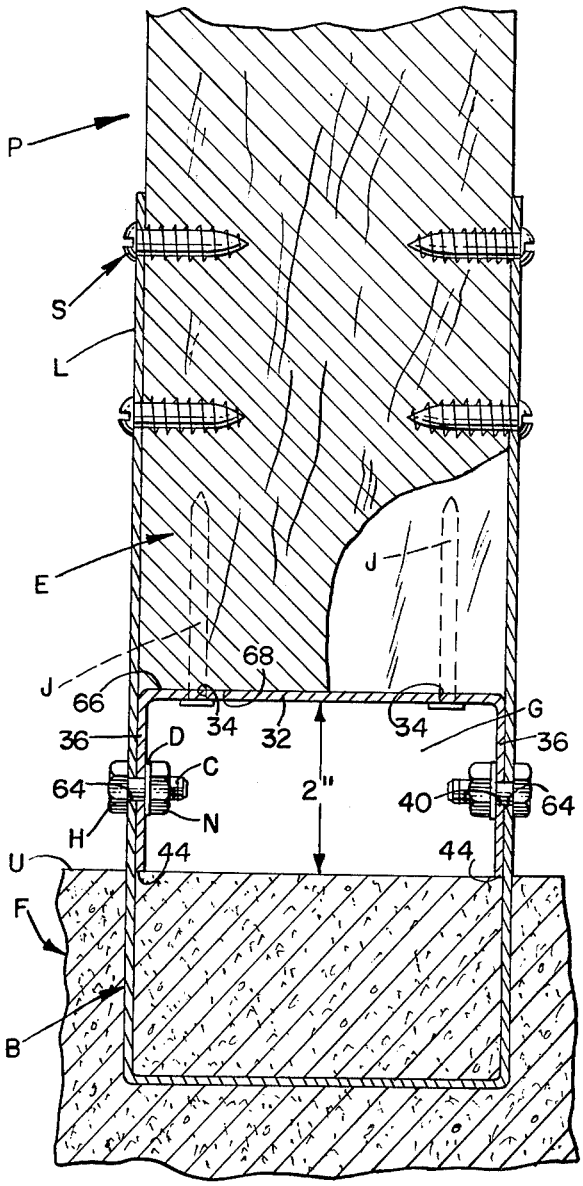
FIG. 2 is an elevation view taken along line 2—2 of FIG. 1.

A U-shaped bracket B is a post anchor and has a pair of upstanding legs L integrally connected together by a web portion W which is embedded in the concrete footing in the usual manner. The bracket B is oriented so that the legs L extend above the footing surface U a desired distance while the bracket is embedded in the concrete a prescribed distance. The legs L have suitable fastener receiving openings O defined therein. As shown in FIG. 2, suitable fasteners, such as self-trapping screws S, are inserted through the openings O and into the post near the lower end E thereof to attach that post securely to the brackets B and thereby securely mount those posts on the footing F.

Figure 3:
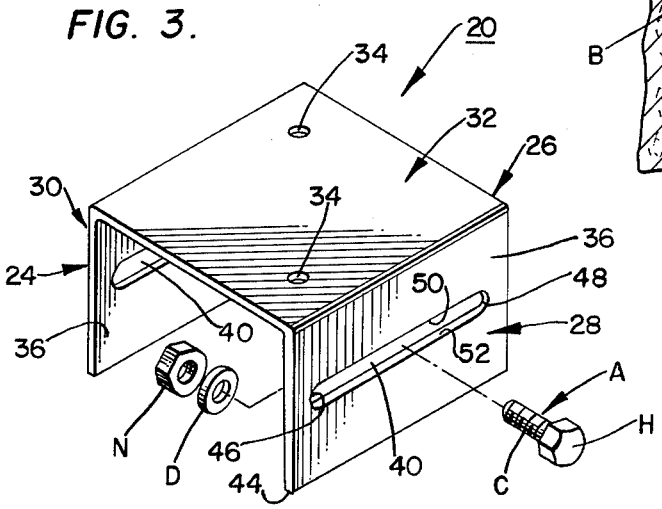
FIG. 3 is a perspective of an end cap embodying the teachings of the present invention.

A unitary, elongate channel-shaped end cap 20 is best shown in FIG. 3 and includes a pair of ends 24 and 26 and a pair of sides 28 and 30. The end cap is elongate and has a longitudinal centerline extending from one end to the other between and parallel to the sides 28 and 30. A planar, essentially rectangular base portion 32 has a pair of fastener receiving holes 34 defined therein near opposite corners thereof. A pair of flanges 36 are located on opposite side edges 28 and 30 of the end cap. It is noted that the end cap is unitary, and can be formed of a single piece of material by rotating the opposite ends thereof through an angle of about 90° to form the channel shape shown in FIG. 3.

Each flange 36 has an elongate adjustment slot 40 defined therein to extend longitudinally of the cap. In one embodiment, the adjustment slots are located approximately midway between the lower terminal edge 44 of each of the flanges and the base portion 32. However, other positions of the slots can be used and the gap between the post lower end E and the support upper surface U is determined by the width of the flanges as measured between the base portion 32 and the terminal edges 44. The adjustment slots 40 each has rounded ends 46 and 48 located respectively near the ends 24 and 26 of the end cap, and each has a pair of parallel sides 50 and 52 defining respectively the top and bottom of the slot. The slots extend longitudinally of the end cap 20 of each has a longitudinal centerline which is in spaced parallelism with the end cap longitudinal centerline and with the end cap base portion. A fastener, such as a bolt A having a head H and a threaded shank C is received in each of the slots which has a width as measured between the top and bottom walls thereof suitable to slidingly accommodate the blot shank C. A washer D and a nut N are positioned on the inside of the cap for engaging the blot to attach the cap to the bracket legs L as will be discussed below.

As shown in FIG. 2, suitable fasteners, such as nails J, are positioned through holes 34 to securely attach the cap 20 to the post lower end E. While two holes 34 are shown, any number and placement of holes 34 can be used without departing from the scope of the present invention.

Each leg L has a bolt receiving opening 64 defined therethrough through which bolts A fit to securely attach the end cap 20 to the bracket B. It is noted that, except for the hole 64, the bracket B is similar to those known in the art, and any bracket having upstanding legs can be used with the end cap 20. As best shown in FIGS. 1 and 2, the end cap flanges serve as spacers between the post lower end E and the footing upper surface U. Thus, the lower terminal edges 44 of the flanges 36 rest flushly on the footing upper surface U while the cap base portion upper surface 66 flushly contacts the lower surface 68 of the post lower end E. The bracket holes 64 are defined through the bracket legs so that the slots 40 are aligned therewith when the cap 20 is in the FIG. 2 gap defining position. The bolts A fit through the aligned holes 64 and slots 40 to securely attach the end cap 20 to the bracket B and thereby further attach the post P to the bracket B. A gap G is thus defined between the post lower end E and the footing upper surface U. In the preferred embodiment, the gap G is two inches in accordance with CHAP 2517—4, but can be other values as will occur to those skilled in the art.

The post can be moved laterally to be properly positioned with respect to a vertical line, while that post is supported in the bracket B at the required height above the footing. The bolts A remain engaged in aligned holes 64 and slots 40, but prior to tightening of the nuts N, can be moved in a horizontal direction, or a direction parallel to the footing upper surface U to thereby move the post laterally and position that post in the desired location. The proper post-surface gap G is thus established and maintained by the cap 20 while the post is adjustably, though securely, attached to the bracket B. The proper lateral orientation of the post on the footing can thus be established without causing a change in the gap G due to the movement of the post, or requiring release of the post from the bracket B.

Once the proper positioning of the post P on the footing F is achieved, the nuts N are tightened. As is evident from the foregoing, the slots 40 permit movement of the post and end cap in a direction which is longitudinal with respect to the end cap, but which prevent movement which is perpendicular with respect to the base portion 32, or, in other words, vertical with respect to the footing. The gap G is thus maintained during positioning of the post on the footing.

Alternative embodiments of the end cap 20 can include various spacings between the slots 40 and the base portion 32, or various widths of the flanges, or the like so that various gaps can be established for the same bracket B and holes 64. Thus, increasing the distance between the slots 40 and the base portion 32 increases the size of gap G for the same bracket B and holes 64, and vice versa.

Figure 4:
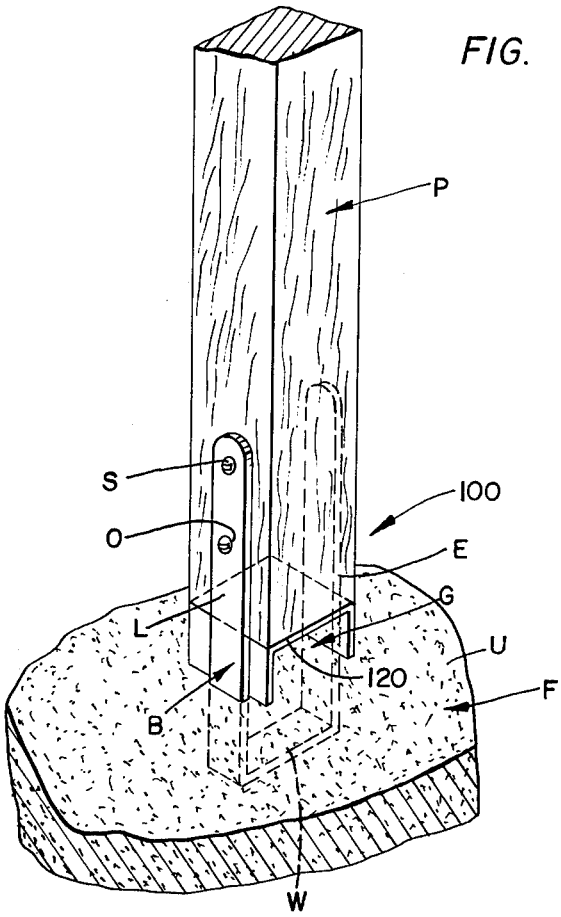
FIG. 4 is a persepctive showing a post supported vertically on a supporting base by a device embodying the teachings of the present invention.

Shown in FIG. 4 is a post support device 100 which elevates a post so that post can be moved laterally but which device does not include slots. The post P is attached at the lower end E thereof by fasteners, such as nails J, or the like to end cap 120. The U-shaped bracket B is embedded in the footing F and includes a pair of upstanding legs L which are integrally connected together by the web portion W. The bracket B is oriented so that the legs L extend above the footing surface U a desired distance while the bracket is embedded in the concrete a prescribed distance. The legs L have suitable fastener receiving openings 0 defined therein. As shown in FIG. 4, suitable fasteners such as self-tapping screws, or the like, are used to attach the post to the bracket.

Figure 5:
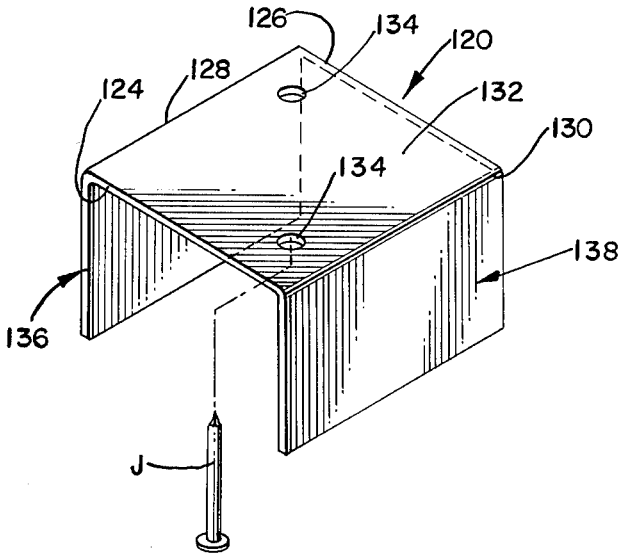
FIG. 5 is a perspective of an end cap embodying the teachings of the present invention.

The end cap 120 is elongate and channel-shaped and is best shown in FIG. 5 as including a pair of ends 124 and 126 and a pair of sides 128 and 130. The end cap 120 is elongate and has a longitudinal centerline extending from one end to the other between and parallel to the sides 128 and 130. A planar, essentially rectangular base portion 132 has a pair of fastener receiving holes 134 defined therein near opposite corners thereof. A pair of flanges 136 are located on opposite side edges 128 and 130 of the end cap. It is noted that the end cap is unitary, and can be formed of a single piece of material by rotating the opposite ends thereof through an angle of about 90° to form the channel shape shown in FIG. 5.

As shown in FIG. 4, the fasteners, such as nails J, are positioned through holes 134 to securely attach the cap 120 to the post lower end E. While two holes 134 are shown, any number and placement of holes 134 can be used without departing from the scope of the present invention.

As with the end cap 20, the post using end cap 120 can be moved laterally to be properly positioned with respect to a vertical line, while that post is supported in the bracket B at the required height above the footing. Once the post is properly oriented, the fasteners, such as screws S, are inserted through the holes 0 in the legs L to attach the post to the bracket B. The proper lateral orientation of the post on the footing can thus be established without causing a change in the gap G due to the movement of the post, or requiring release of the post from the bracket B.

As is evident from the foregoing, the end cap 120 permits movement of the post in a direction which is longitudinal with respect to the end cap, but which prevents movement which is perpendicular with respect to the base portion 132, or, in other words, vertical with respect to the footing. The gap G is thus maintained in this embodiment also during positioning of the post on the footing.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. A post supporting device comprising:

a support bracket mounted in a supporting structureand having a pair of upstanding legs for mounting an elongate post in an upright orientation, said upstanding legs each having a fastener receiving hole defined therethrough;

an elongate end cap connected to one end of a post, said end cap being unitary and channel-shaped and having a longitudinal centerline, a base portion and a pair of flanges thereon, an elongate adjustment slot defined in each of said flanges to extend longitudinally of said end cap and positioned between said base portion and a terminal edge of said each flange so that each slot is in alignment with each of said bracket fastener receiving holes;

first fastening means attaching said end cap base portion to one end of a post; and second fastening means located in said aligned slots and bracket fastener receiving holes attaching said end cap to said bracket and thereby attaching a post to said bracket, said end cap flanges contacting a surface of said supporting structure to maintain a predetermined spacing between said post lower end and said surface, said slots permitting movement of said end cap with respect to said support bracket in a direction transverse to the longitudinal centerline of the upright elongate post while said predetermined spacing is maintained.

2. The post supporting device of claim 1 wherein said end cap is channel-shaped.

3. The post supporting device of claim 1 wherein said predetermined spacing is at least two inches.

4. The post supporting device of claim 1 wherein said supporting surface includes a concrete footing.

5. The post supporting device of claim 1 wherein the post is wooden.

6. The post supporting device of claim 4 wherein said supporting bracket is U-shaped and has a base portion embedded in said concrete footing.

7. The post supporting device of claim 1 wherein said slots each have curved ends.

8. A post supporting device comprising:

a support bracket mounted in a supporting structure and having a pair of upstanding legs for mounting an elongate post in an upright orientation;

an elongate end cap connected to one end of a post, said end cap being unitary and channel-shaped and having a longitudinal centerline, a base portion and a pair of flanges thereon;

first fastening means attaching said end cap base portion to one end of a post;

second fastening means attaching said end cap flanges to said support bracket upstanding legs; and third fastening means attaching each of said bracket legs to a post, said end cap flanges contacting a surface of said supporting structure to maintain a predetermined spacing between said post lower end and said surface, said second fastening means permitting movement of said end cap with respect to said support bracket in a direction transverse to the longitudinal centerline of the upright elongate post while said predetermined spacing is maintained by contact between said end cap flanges and said supporting structure surface.

9. The post supporting device of claim 8 wherein said supporting surface includes a concrete footing.

10. The post supporting device of claim 9 wherein said supporting bracket is U-shaped and has a base portion embedded in said concrete footing.

* * * * *